United States Patent [19]

Till et al.

[11] Patent Number: 4,736,227

[45] Date of Patent: Apr. 5, 1988

[54] LIQUID INK TRANSFER SYSTEM

[75] Inventors: Henry R. Till, Rochester; Fredrick A. Warner, Fairport; Charles A. Radulski, Macedon, all of N.Y.

[73] Assignee: Xerox Corporation, Stamford, Conn.

[21] Appl. No.: 56,165

[22] Filed: Jun. 1, 1987

[51] Int. Cl.[4] ..... G03G 15/14

[52] U.S. Cl. ..... 355/3 TR; 355/14 TR; 355/10

[58] Field of Search ..... 355/3 TR, 10, 14 TR; 430/33, 48, 126, 104; 250/324, 325, 326

[56] References Cited

U.S. PATENT DOCUMENTS

| | | | |
|---|---|---|---|
| 3,734,724 | 5/1973 | York | 96/1.4 |
| 3,966,199 | 6/1976 | Silverber | 271/275 |
| 4,014,605 | 3/1977 | Fletcher | 355/3 R |
| 4,055,380 | 10/1977 | Borostyan | 355/3 TR |
| 4,171,157 | 10/1979 | Suzuki | 355/3 TR |
| 4,190,348 | 2/1980 | Friday | 355/3 TR |

*Primary Examiner*—R. L. Moses

*Attorney, Agent, or Firm*—H. Fleischer; J. E. Beck; R. Zibelli

[57] ABSTRACT

An apparatus in which a liquid image is transferred from a surface to a substantially electrically non-conductive, flexible copy sheet with the liquid image being charged to one polarity and the surface being charged to a polarity opposite to the polarity of the charge of the liquid image. A first charge is applied on the copy sheet. The first charge is of the same polarity as the polarity of the charge of the liquid image. This causes the copy sheet to adhere releasably to the surface with the liquid image being interposed therebetween. A second charge is applied on the copy sheet after the first charge has been applied thereon. The second charge is of an opposite polarity to the polarity of the charge of the liquid image. This causes the liquid image to be attracted to the copy sheet.

14 Claims, 2 Drawing Sheets

LIQUID INK TRANSFER SYSTEM

This invention relates generally to an electrophotographic printing machine, and more particularly concerns transferring a liquid image from a photoconductive surface to a copy sheet.

Generally, the process of electrophotographic printing includes charging a photoconductive member to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed by bringing a liquid developer material into contact therewith. The liquid developer material is deposited, in image configuration, on the photoconductive member. Thereafter, the liquid image is transferred to the copy sheet. The liquid image includes residual liquid carrier and pigmented particles. After transfer, heat is applied to the copy sheet to permanently fuse the pigmented particles to the copy sheet and vaporize the residual liquid carrier adhering thereto.

Transfer of the liquid image to the copy sheet is generally achieved by applying an electrostatic force, in the transfer zone, to overcome the forces holding the liquid image to the photoconductive surface. These electrostatic forces are usually provided by a corona generating device spraying ions onto the backside of the copy sheet or by an electrically biased roller or belt engaging the backside of the copy sheet in the transfer zone. The liquid image is not always completely transferred and smudging or smear of the liquid image often results. In order to achieve good transfer of the liquid image, the electrostatic field and contact pressure are critical. An uneven or non-uniform charge on the copy sheet can cause defects observable in the final image on the copy sheet. Hereinbefore, various techniques have been devised for transferring a toner image to a copy sheet. The following patents appear to be relevant:

U.S. Pat. No. 3,734,724; Patentee: York; Issued: May 22, 1973.

U.S. Pat. No. 3,966,199; Patentee: Silverberg; Issued: June 29, 1976.

U.S. Pat. No. 4,014,605; Patentee: Fletcher; Issued: Mar. 29, 1976.

The relevant portions of the foregoing patents may be briefly summarized as follows:

York discloses a process for forming a lithographic plate. An electrostatic latent image, recorded on an electrophotographic element, is developed with toner. The toner may be a liquid or dry material. An electrically conductive receiver is charged to the same polarity as the polarity of the charge of the toner developed on the latent image. The receiver is then placed in face-to-face contact with the latent image. The charge on the receiver repels the toner preventing the toner image from being disturbed. A charge having an opposite polarity is than applied to the receiver to attract the toner image thereto. If the element having the latent image recorded thereon is transparent, the latent image can be flood illuminated so as to be discharged. The receiver is used as a lithographic plate.

Silverberg teaches an electrostatographic copying system which utilizes a transport belt to move a copy sheet through a toner transfer station. Guide fingers and a corona generator form a station at which a copy sheet is electrostatically tacked onto the transfer belt.

Fletcher discloses a transfer system for an electrophotographic copying machine which employs selective exposure of a photoconductive transfer member. Tailored transfer fields with tailored illumination of a photoconductive material enhances the quality of image transfer from a photoreceptive member to a receiving substrate. A system is provided for tacking a copy sheet to a photoconductive transport belt by simultaneously activating a charging device and an illuminating source.

In accordance with one aspect of the present invention, there is provided an apparatus for transferring a liquid image from a surface to a substantially non-conductive, flexible copy sheet. The liquid image is charged to one polarity with the surface being charged to a polarity opposite to the polarity of the charge of the liquid image. First means apply a first charge on the copy sheet. The first charge on the copy sheet is of the same polarity as the charge of the liquid image to cause the copy sheet to adhere releasably to the surface with the liquid image being interposed therebetween. Second means apply a second charge on the copy sheet after the first charge has been applied thereon. The second charge on the copy sheet is of an opposite polarity to the charge of the liquid image. This causes the liquid image to be attracted to the copy sheet.

Pursuant to another aspect of the features of the present invention, there is provided an electrophotographic printing machine of the type having an electrostatic latent image recorded on a photoconductive surface. The latent image is developed with a liquid developer material to form a liquid image thereon. The liquid image is transferred from the photoconductive surface to a substantially nonconductive, flexible copy sheet. The liquid image is charged to one polarity and the charge of the photoconductive surface is charged to a polarity opposite to the polarity of the charge of the liquid image. First means apply a first charge on the copy sheet. The first charge on the copy sheet is of the same polarity as the charge of the liquid image to cause the copy sheet to adhere releasably to the photoconductive surface with the liquid image being interposed therebetween. Second means apply a second charge on the copy sheet after the first charge has been applied thereon. The second charge on the copy sheet is of an opposite polarity to the charge of the liquid image. This causes the liquid image to be attracted to the copy sheet.

Other aspects of the present invention will become apparent as the following description proceeds and upon reference to the drawings, in which.

While the present invention will be described hereinafter in conjunction with various embodiments thereof, it will be understood that it is not intended to limit the invention to these embodiments. On the contrary, it is intended to cover all alternatives, modifications, and equivalents as may be included within the spirit and scope of the invention ad defined by the appended claims.

Inasmuch as the art of electrophotographic printing is well known, the various processing stations employed in the FIG. 1 printing machine will be shown hereinafter schematically and their operation described briefly with reference thereto.

Figure 1:
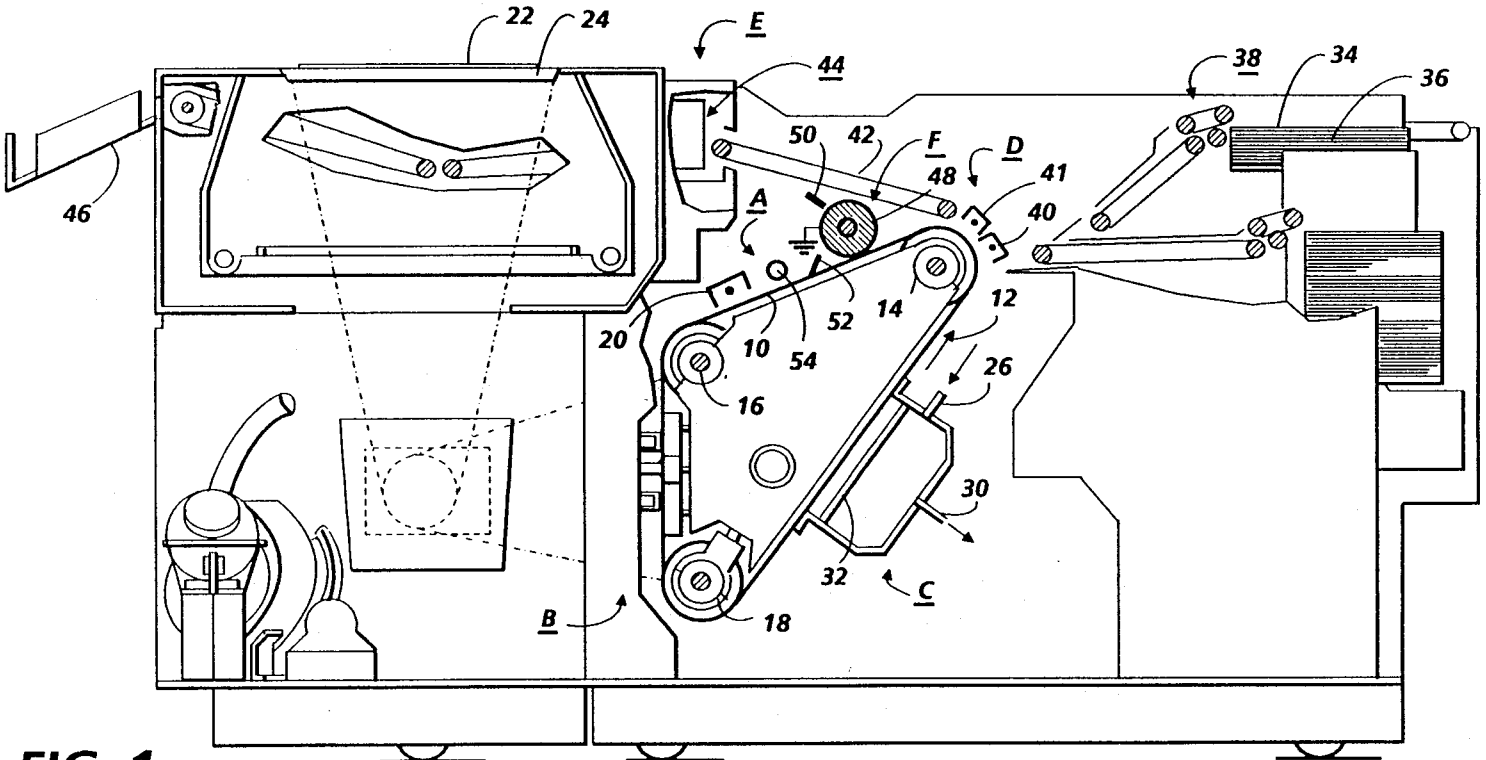
FIG. 1 is a schematic elevational view showing an illustrative electrophotographic printing machine incorporating the features of the present invention therein.

Turning now to FIG. 1, the electrophotographic printing machine employs a belt 10 having a photoconductive surface deposited on a conductive substrate. Preferably, the photoconductive surface is made from a selenium alloy with the conductive substrate being made from an electrically grounded aluminum alloy. Other suitable photoconductive surfaces and conductive substrates may also be employed. Belt 10 moves in the direction of arrow 12 to advance successive portions of the photoconductive surface through the various processing stations disposed about the path of movement thereof. Belt 10 is supported by three rollers 14, 16, and 18 located with parallel axes at approximately the apexes of a triangle. Roller 14 is rotatably driven by a suitable motor associated with a drive (not shown) to move belt 10 in the direction of arrow 12.

Initially, a portion of belt 10 passes through charging station A. At charging station A, a corona generating device, indicated generally by the reference numeral 20, charges the photoconductive surface of belt 10 to a relatively high, substantially uniform potential.

Next, the charged portion of the photoconductive surface is advanced through exposure station B. At exposure station B, an original document 22 is positioned face down upon a transparent platen 24. Lamps flash light rays onto original document 22. The light rays reflected from original document 22 are transmitted through a lens forming a light image thereof. The lens focuses the light image onto the charged portion of the photoconductive surface to selectively dissipate the charge thereon. This records an electrostatic latent image on the photoconductive surface corresponding to the informational areas contained within the original document. Thereafter, belt 10 advances the electrostatic latent image recorded on the photoconductive surface to development station C.

At development station C, a developing liquid comprising an insulating carrier liquid and toner particles, is circulated from any suitable source (not shown) through pipe 26 into development tray 28 from which it is withdrawn through pipe 30 for recirculation. Development electrode 32, which may be appropriately electrically biased, assists in developing the electrostatic latent image with the toner particles, i.e. the pigmented particles dispersed in the liquid carrier, as it passes in contact with the developing liquid. The charged toner particles, disseminated throughout the carrier liquid, pass by electrophoresis to the electrostatic latent image. The charge of the toner particles is opposite in polarity to the charge on the photoconductive surface. By way of example, if the photoconductive surface is made from a selenium alloy, the photoconductive surface will be positively charged and the toner particles will be negatively charged. Alternatively, if the photoconductive surface is made from a cadmium sulfide material, the photoconductive surface will be negatively charged and the toner particles will be positively charged. Generally, the amount of liquid carrier on the photoconductive surface is too great. A roller (not shown) whose surface moves in a direction opposite to the direction of movement of the photoconductive surface, is spaced from the photoconductive surface and adapted to shear excessive liquid from the developed image without disturbing the image. Preferably, the developer material includes a liquid insulating carrier having pigmented particles, i.e. toner particles dispersed therein. A suitable insulating liquid carrier may be made from an aliphatic hydrocarbon, such as an Isopar, which is a trademark of the Exxon Corporation, having a low boiling point. The toner particles include a pigment, such as carbon black, associated with the polymer. A suitable liquid developer material is described in U.S. Pat. No. 4,582,774, issued to Landa in 1986, the relevant portions thereof being incorporated into the present application.

After development, belt 10 advances the developed image to transfer station D. At transfer station D, a sheet of support material 34, i.e. a copy sheet made from a substantially non-conductive paper, is advanced from stack 36 by a sheet feeder, indicated generally by the reference numeral 38. The sheet of support material advances in synchronism with the movement of the developed image on belt 10 so as to arrive simultaneously therewith at transfer station D. Transfer station D includes a corona generating device 40 which sprays ions onto the backside of the electrically non-conductive paper 34 to charge the paper to the same polarity as the charge on the toner particles. This charge tacks the copy paper to the photoconductive surface and drives the toner particles toward the photoconductive surface so that the toner image is not disturbed by the copy paper. The copy paper, tacked to the photoconductive surface moves beneath corona generating device 41. Corona generating device 41 sprays ions onto the backside of the electrically non-conductive paper 34 to charge the paper to a polarity opposite to the polarity of the charge on the toner particles. This attracts the developed toner image from the photoconductive surface to the copy paper. The detailed structure of the various embodiments of the transfer system will be described hereinafter with reference to FIG. 2 and FIG. 3. After transfer, the copy paper continues to move onto conveyor 42 which advances the sheet to fusing station E.

Fusing station E includes a fusing system indicated generally by the reference 44. The fuser assembly, e.g. a radiant heater, vaporizes the liquid carrier from the copy sheet and permanently fuses the toner particles in image configuration thereto. After fusing, the copy sheet is advanced to catch tray 46 for subsequent removal from the printing machine by the operator.

After the copy sheet is separated from the photoconductive surface of belt 10, some residual liquid developer material remains adhering thereto. This residual developer material is removed from the photoconductive surface at cleaning station F. Cleaning station F includes a cleaning roller 48, formed of any appropriate synthetic resin driven in a direction opposite to the direction of movement of the photoconductive surface to scrub the photoconductive surface clean. To assist in this action, developing liquid may be fed through pipe 50 onto the surface of cleaning roller 48. A wiper blade 52 completes the cleaning of the photoconductive surface. Any residual charge left on the photoconductive surface is extinguished by flooding the photoconductive surface with light from lamp 54.

It is believed that the foregoing description is sufficient for purposes of the present application to illustrate the general operation of an electrophotographic printing machine incorporating the features of the present invention therein.

Figure 2:
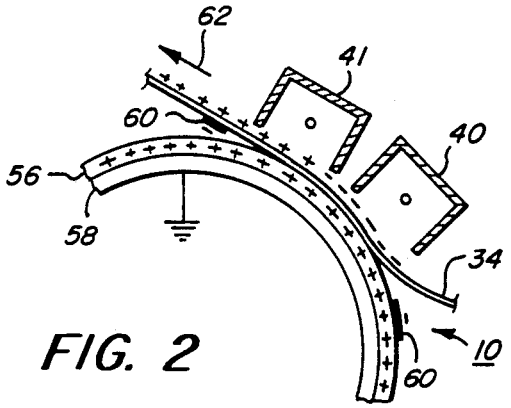
FIG. 2 is an elevational view depicting one embodiment of a transfer system used in the FIG. 1 printing machine.

Referring now to FIG. 2, there is shown belt 10 having a photoconductive surface 56 coated on a conductive substrate 58. Conductive substrate 58 is electrically grounded. As depicted, photoconductive surface 56 is positively charged. Toner particles 60, adhering to photoconductive surface 56 in image configuration, are negatively charged. Electrically non-conductive copy paper 34 advances in the direction of arrow 62 beneath corona generating device 40. Corona generating device 40 sprays ions onto the backside of copy paper 34 to induce a negative charge thereon. The negatively charged copy paper is attracted to the positively charged photoconductive surface. In this way, the copy paper is tacked to the photoconductive surface. The negative charge on the copy paper repels the negatively charged toner particles. The toner particles are driven toward the photoconductive surface and are not disturbed by the tacking of the copy paper thereto. As the copy paper continues to move in the direction of arrow 62, it passes beneath corona generating device 41. Corona generating device 41 sprays ions onto the backside of the copy sheet to induce a positive charge thereon. The positively charged copy paper attracts the negatively charged toner particles thereto in image configuration. The copy sheet is now repelled from the positively charged photoconductive surface with the toner image adhering thereto.

Figure 3:
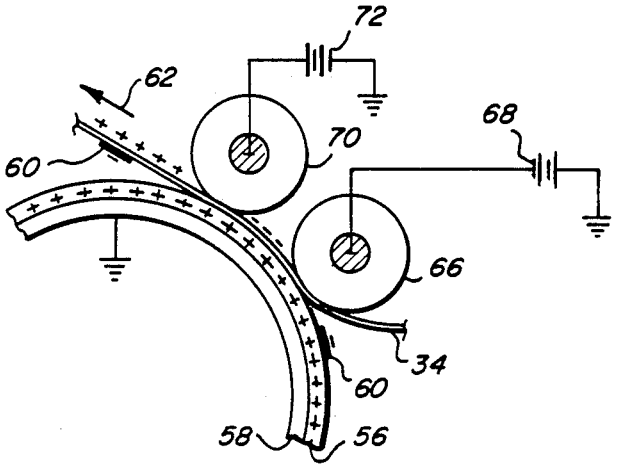
FIG. 3 is an elevational view showing another embodiment of the FIG. 2 transfer system.

Referring now to FIG. 3, there is shown another embodiment of the transfer apparatus of the present invention. Belt 10 has a photoconductive surface 56 coated on a conductive substrate 58. Conductive substrate 58 is electrically grounded. As depicted, photoconductive surface 56 is positively charged. Toner particles 60, adhering to photoconductive surface 56 in image configuration, are negatively charged. Electrically non-conductive copy paper 34 is advanced in the direction of arrow 62. Copy paper 34 passes through a nip defined by roller 66 and photoconductive surface 56. Roller 66 is electrically connected to voltage source 68. Voltage source 68 electrically biases roller 66 to a negative potential. As copy paper 34 passes through the nip defined by roller 66 and photoconductive surface 56, it is charged to a negative polarity. The negatively charged copy paper is attracted to the positively charged photoconductive surface. In this way, the copy paper is tacked to the photoconductive surface. The negative charge on the copy papar repels the negatively charged toner particles. The toner particles are driven toward the photoconductive surface and are not disturbed by the tacking of the copy paper thereto. As the copy paper continues to move in the direction of arrow 62, it passes through the nip defined by roller 70 and photoconductive surface 56 of belt 10. Voltage source 72 electrically biases roller 66 to a positive potential. As copy paper 45 passes through the nip defined by roller 70 and photoconductive surface 56, it is charged to a positive polarity. The negatively charged toner particles are attracted from the photoconductive surface to the positively charged copy sheet, in image configuration. The copy sheet is now repelled from the positively charged photoconductive surface with the toner image adhering thereto.

One skilled in the art will appreciate that the transfer apparatus of the present invention is not limited to the specific embodiments depicted in FIGS. 2 and 3. For example, roller 66 and voltage source 68 of FIG. 3 may be used in FIG. 2 in lieu of corona generating device 40 of FIG. 2. Alternatively, corona generating device 41 of FIG. 2 may be used in FIG. 3 instead of roller 70 and voltage source 72.

In recapitulation, it is clear that the transfer system of the present invention induces a charge on an advancing electricaly nonconductive copy sheet of the same polarity as the charge on the liquid developer adhering to the photoconductive surface. This causes the copy sheet to be tacked to the photoconductive surface and the toner particles of the liquid developer to move toward the photoconductive surface. In this manner, the toner image remains undisturbed as the copy sheet is tacked to the photoconductive surface. Thereafter, the copy sheet is charged to the opposite polarity so as to attract the toner image thereto. Simultaneously, the copy sheet is repelled from the photoconductive surface so as to be readily removed therefrom.

It is, therefore, evident that there has been provided in acordance with the present invention, a transfer system that fully satisfies the aims and advantages heretofore mentioned. While this invention has been described in conjunction with various embodiments, it is evident that many alternatives, modifications and variations will be apparent to those skilled in the art. Accordingly, it is intended to embrace all such alternatives, modifications and variations that fall within the spirit and broad scope of the appended claims.

We claim:

1. An apparatus for transferring a liquid image from a surface to a substantially electrically non-conductive, flexible copy sheet with the liquid image being charged to one polarity and the surface being charged to a polarity opposite to the polarity of the charge of the liquid image, including:

first means for applying a first charge on the copy sheet with the first charge on the copy sheet being of the same polarity as the polarity of the charge of the liquid image to cause the copy sheet to adhere releasably to the surface with the liquid image being interposed therebetween; and second means for applying a second charge on the copy sheet after the first charge has been applied thereon with the second charge on the copy sheet being of an opposite polarity to the polarity of the charge of the liquid image to cause the liquid image to be attracted to the copy sheet.

2. An apparatus according to claim 1, wherein the liquid image includes a liquid carrier having toner particles dispersed therein.

3. An apparatus according to claim 2, wherein the first charge applied on the copy sheet by said first means moves the toner particles toward the surface so that the copy sheet does not disturb the liquid image.

4. An apparatus according to claim 3, wherein said first means includes a corona generating device arranged to spray ions onto the back side of the copy sheet to apply a charge on the copy sheet having the same polarity as the polarity of the charge of the liquid image.

5. An apparatus according to claim 3, wherein said second means includes a corona generating device arranged to spray ions onto the back side of the copy sheet, after the first charge has been applied thereon, to apply a charge on the copy sheet having the opposite polarity to the polarity of the charge of the liquid image.

6. An apparatus according to claim 3, wherein said second means includes an electrically biased roller arranged to contact the copy sheet, after the first charge has been applied thereon, so as to charge the copy sheet to the opposite polarity to the polarity of the charge of the liquid image.

7. An apparatus according to claim 3, wherein said first means includes an electrically biased roller arranged to contact the copy sheet so as to charge the copy sheet to the same polarity as the the polarity of the charge of the liquid image.

8. An electrophotographic printing machine of the type having an electrostatic latent image recorded on a photoconductive surface developed with a liquid developer material to form a liquid image thereon, wherein the liquid image is transferred from the photoconductive surface to a substantially electrically non-conductive, flexible copy sheet with the liquid image being charged to one polarity and the photoconductive surface being charged to a polarity opposite to the polarity of the charge of the liquid image, including:

first means for applying a first charge on the copy sheet with the first charge on the copy sheet being of the same polarity as the polarity of the charge of the liquid image to cause the copy sheet to adhere releasably to the photoconductive surface with the liquid image being interposed therebetween; and second means for applying a second charge on the copy sheet after the first charge has been applied thereon with the second charge on the copy sheet being of an opposite polarity to the polarity of the charge of the liquid image to cause the liquid image to be attracted to the copy sheet.

9. A printing machine according to claim 8, wherein the liquid image includes a liquid carrier having toner particles dispersed therein.

10. A printing machine according to claim 9, wherein the first charge applied on the copy sheet by said first means moves the toner particles toward the photoconductive surface so that the copy sheet does not disturb the liquid image.

11. A printing machine according to claim 10, wherein said first means includes a corona generating device arranged to spray ions onto the back side of the copy sheet to apply a charge on the copy sheet having the same polarity as the polarity of the charge of the liquid image.

12. A printing machine according to claim 10, wherein said second means includes a corona generating device arranged to spray ions onto the back side of the copy sheet, after the first charge has been applied thereon, to apply a charge on the copy sheet having the opposite polarity to the polarity of the charge of the liquid image.

13. A printing machine according to claim 10, wherein said second means includes an electrically biased roller arranged to contact the copy sheet, after the first charge has been applied thereon, so as to charge the copy sheet to the opposite polarity to the polarity of the charge of the liquid image.

14. A printing machine according to claim 10, wherein said first means includes an electrically biased roller arranged to contact the copy sheet so as to charge the copy sheet to the same polarity as the polarity of the charge of the liquid image.

* * * * *